US008100757B2

(12) United States Patent
Melendez

(10) Patent No.: US 8,100,757 B2
(45) Date of Patent: Jan. 24, 2012

(54) GAME-BASED APPARATUS, SYSTEM, AND METHOD FOR LIFESTYLE GOAL ACHIEVEMENT

(76) Inventor: Michelle L. Melendez, Mountain View, CA (US)

( * ) Notice: Subject to any disclaimer, the term of this patent is extended or adjusted under 35 U.S.C. 154(b) by 413 days.

(21) Appl. No.: 12/479,680

(22) Filed: Jun. 5, 2009

(65) Prior Publication Data

US 2009/0305772 A1 Dec. 10, 2009

Related U.S. Application Data

(60) Provisional application No. 61/131,281, filed on Jun. 5, 2008.

(51) Int. Cl.
*G06F 19/00* (2011.01)

(52) U.S. Cl. ..... 463/23; 463/15; 463/16; 463/17; 463/18; 463/19

(58) Field of Classification Search ..... 463/15–25
See application file for complete search history.

(56) References Cited

U.S. PATENT DOCUMENTS

| | | | | |
|---|---|---|---|---|
| 4,344,625 | A | 8/1982 | Frudakis | |
| 4,440,396 | A | 4/1984 | Frudakis | |
| 4,640,512 | A * | 2/1987 | Burke | 273/157 R |
| 4,756,533 | A * | 7/1988 | Hopkins et al. | 273/157 R |
| 6,039,688 | A * | 3/2000 | Douglas et al. | 600/300 |
| 6,246,992 | B1 * | 6/2001 | Brown | 705/2 |
| 6,572,380 | B1 | 6/2003 | Buckley et al. | |
| 6,679,188 | B1 * | 1/2004 | Spagnoli, Jr. | 108/44 |
| 6,679,493 | B1 * | 1/2004 | Stephenson | 273/155 |
| 6,702,586 | B1 * | 3/2004 | Miller | 434/406 |
| 7,004,834 | B2 * | 2/2006 | Walker et al. | 463/16 |
| 7,769,605 | B2 * | 8/2010 | Brown | 705/3 |
| 7,918,457 | B2 * | 4/2011 | Wittevrongel | 273/153 S |
| 2001/0049297 | A1 * | 12/2001 | Hibscher et al. | 463/9 |
| 2003/0032033 | A1 * | 2/2003 | Anglin et al. | 435/6 |
| 2003/0144052 | A1 * | 7/2003 | Walker et al. | 463/20 |
| 2004/0046318 | A1 * | 3/2004 | Christensen | 273/153 S |
| 2004/0160003 | A1 * | 8/2004 | Forrest et al. | 273/248 |
| 2005/0266906 | A1 * | 12/2005 | Stevens | 463/1 |
| 2006/0151947 | A1 * | 7/2006 | Fredrickson | 273/157 R |
| 2006/0252518 | A1 * | 11/2006 | Walker et al. | 463/25 |
| 2006/0252519 | A1 * | 11/2006 | Walker et al. | 463/25 |
| 2007/0087797 | A1 * | 4/2007 | Van Luchene | 463/1 |
| 2007/0226062 | A1 * | 9/2007 | Hughes et al. | 705/14 |
| 2008/0065413 | A1 * | 3/2008 | Taniike et al. | 705/2 |
| 2010/0227669 | A1 * | 9/2010 | Van Luchene | 463/23 |

* cited by examiner

*Primary Examiner* — N Drew Richards
*Assistant Examiner* — Ankush Singal
(74) *Attorney, Agent, or Firm* — Kunzler Needham Massey & Thorpe

(57) ABSTRACT

An apparatus, system, and method are disclosed in which players achieve various lifestyle goals through interactive game-playing. A plurality of game elements is provided, wherein information regarding an activity in pursuit of a lifestyle improvement goal is displayed on a surface of each game element. A game framework is provided, comprising a spatial representation of an actual accomplishment by a player of the activity in pursuit of the lifestyle improvement goal. A journal is also provided, comprising a written representation of the actual accomplishment by the player of the activity in pursuit of the lifestyle improvement goal. A timing device may also be provided that times the actual accomplishment of the activity in pursuit of a lifestyle improvement goal by the player, according to a timing criterion that comprises at least one of a lower time limit and an upper time limit.

20 Claims, 7 Drawing Sheets

302

Aces Are Wild

Fitness is a journey and we all have our ups and downs.

This card will give you a for an extra challenge you missed or allow you to complete a game card activity if you skipped one and receive all points associated with that card. If you don't need it, save this card and use if and when you do.

Congratulations!

304

Revelation Fitness™

#9 Card In Play
Wild Card

Week #2

404

Exciting Start to Fitness Weight Loss Game Score Card

Winner of The Game: Total Pts:

Keep this score card close to your game by tacking it next to the game or placing it somewhere players can see it everyday! Make sure the score card for the week being played is visible. Players give themselves points every day as game cards are completed. If you are playing against yourself, keep your score cards and each time you play the game try and beat your past score. The winner of each week writes their name, their points and the date in the middle of each score card and the winner of the game does the same on this page. Remember success is achieved quickest when tracked!

You can do this! You are meant to be fit and love your body!!
All my best to your success!!

1st Score Card Page: Exciting Start to Fitness Weight Loss Game Score Card 408

| Game Card | Points | Extra Challenge Points | Extra Activity Points |
|---|---|---|---|
| My Time | 7 | 12 | 15 |
| Intuitive Eating | 5 | 10 | 12 |
| Journal | 5 | 10 | - |
| Reciprocation | 5 | 10 | 10 |
| 1 Million lbs Lost Game | 5 | 10 | ——— |

410

Week 1 Winner: Points: Date:

406

| Name | Day 1 Wk 1 | Day 2 Wk 1 | Day 3 Wk 1 | Day 4 Wk 1 | Day 5 Wk 1 | Day 6 Wk 1 | Day 7 Wk 1 | **Total** |
|---|---|---|---|---|---|---|---|---|
| 402 | | | | | | | | |
| | | | | | | | | |
| | | | | | | | | |
| | | | | | | | | |

FIG. 4

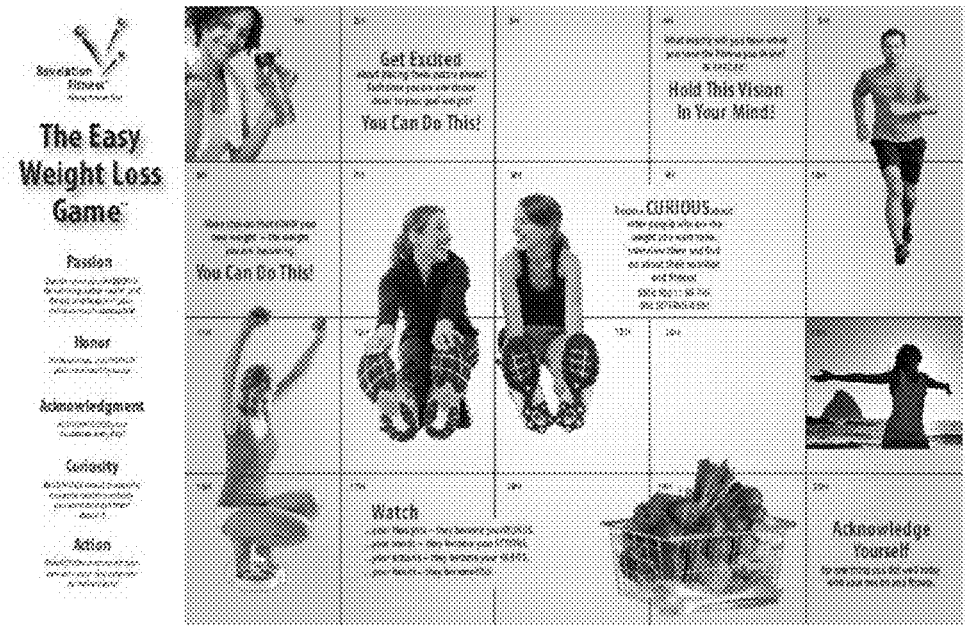
702
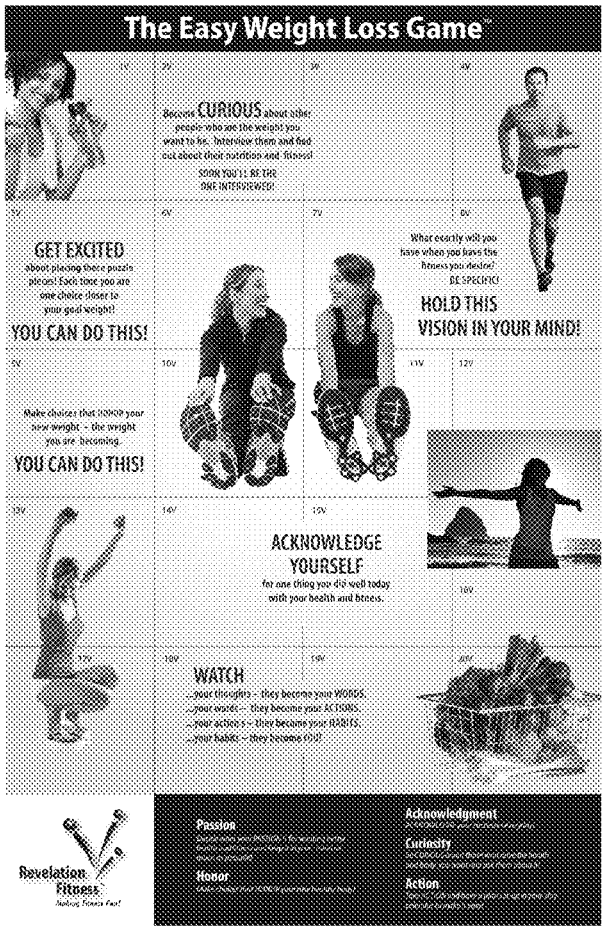
704
FIG. 7

804
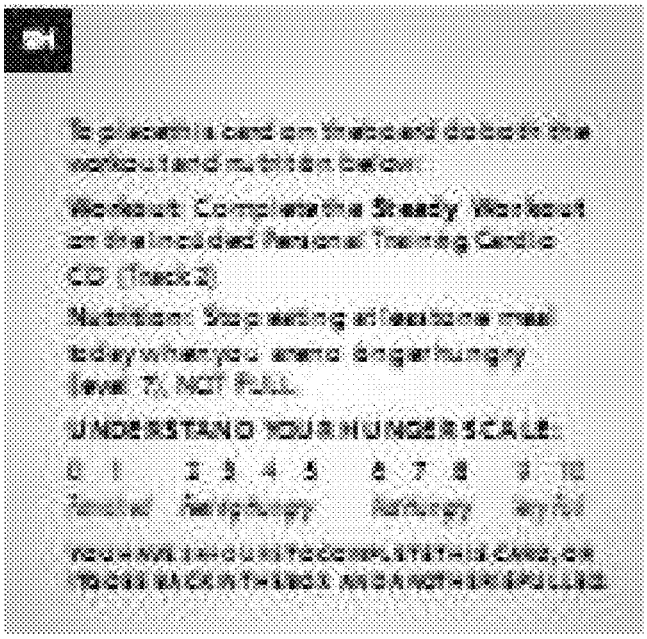
802
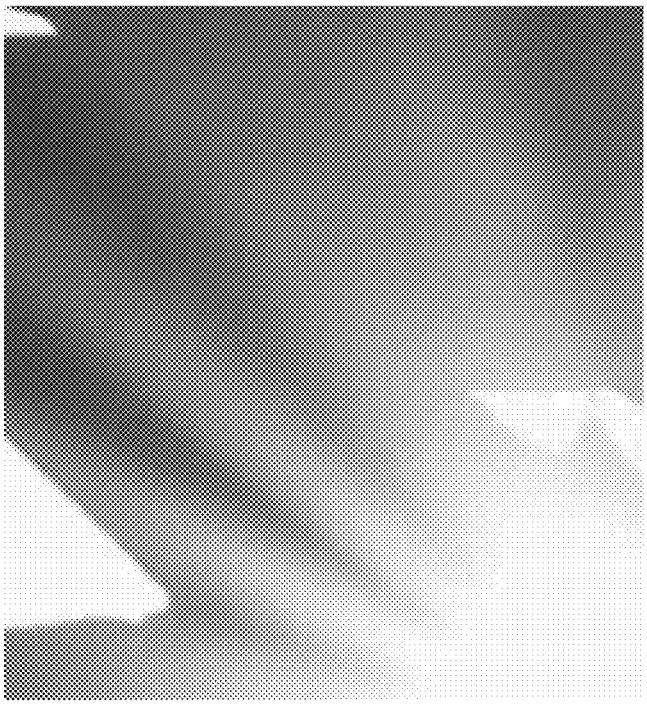
FIG. 8

GAME-BASED APPARATUS, SYSTEM, AND METHOD FOR LIFESTYLE GOAL ACHIEVEMENT

CROSS-REFERENCES TO RELATED APPLICATIONS

This application claims priority to U.S. Provisional Patent Application No. 61/131,281 entitled "Game Apparatus and Method for Achieving a Lifestyle Goal" and filed on Jun. 5, 2008 for Michelle Louise Melendez, which is incorporated herein by reference.

BACKGROUND

1. Field of the Invention

This invention relates to lifestyle games and more particularly relates to motivational games to yield actual lifestyle improvements by the participants.

2. Description of the Related Art

Lifestyle games may be of several types. Some are simply tutorial in nature. Others involve simulation for purposes of education or entertainment. A more challenging type is intended to motivate the players to make actual lifestyle changes in real life.

Games of the latter type often fall short of achieving the lasting results that are desired. Devising lifestyle games which are sufficiently motivational to yield actual lifestyle changes in the participants has proven to be a difficult problem.

SUMMARY

From the foregoing discussion, it should be apparent that a long-felt unmet need exists for a game-based apparatus, system, and method that encourage lifestyle goal achievement. Beneficially, such an apparatus, system, and method would motivate players to actual accomplishment of activities in pursuit of a lifestyle improvement goal.

The present invention has been developed in response to the present state of the art, and in particular, in response to the problems and needs in the art that remain intractable under currently available lifestyle games. Accordingly, the present invention has been developed to provide an apparatus, system, and method for lifestyle goal achievement that overcome many or all of the above-discussed shortcomings in the art.

The apparatus to achieve a lifestyle goal is provided with a plurality of modules configured to functionally execute the necessary steps of providing the game, guiding an individual to set the lifestyle improvement goal, recommending that the individual play the game, and instructing the individual in the playing procedure. These modules in the described embodiments include a plurality of game elements, wherein information regarding an activity in pursuit of a lifestyle improvement goal may be displayed on a surface of each game element, a game framework may comprise a spatial representation of an actual accomplishment by a player of the activity in pursuit of the lifestyle improvement goal; and a journal may comprise a written representation of the actual accomplishment by the player of the activity in pursuit of the lifestyle improvement goal.

The apparatus, in one embodiment, may comprise a puzzle, wherein each game element is a piece of the puzzle and the spatial representation comprises an assemblage of the puzzle pieces within the game framework. In a further embodiment, the assemblage comprises an image, the puzzle piece comprises a card with a portion of the image on a back thereof, the surface comprises a face of the card, and the game framework comprises a game board to receive the card face-down. In another embodiment, the puzzle and puzzle pieces may also be three-dimensional.

The apparatus is further configured, in one embodiment, to provide reward symbols, which may indicate successful completion of the activity, or may indicate successful progress in playing the game through a predetermined time period.

In a further embodiment, the apparatus maybe configured to include an extra challenge by which the player can make further progress in the game. The plurality of game elements may also include one or more wildcard elements by which the player can make further progress in the game without actual accomplishment of the activity displayed on the surface of another game element A system of the present invention is also presented for lifestyle goal achievement. The system may be embodied by foregoing apparatus modules in addition to a timing device that times the actual accomplishment of the activity in pursuit of a lifestyle improvement goal by the player. In particular, the system, in one embodiment, includes a count-down timer.

The system may further include a computing environment in which the game is implemented as a software application. The software application may be standalone or web-based. In a further embodiment, the web-based software application may enable geographically dispersed players to play the game together.

A method of the present invention is also presented for lifestyle goal achievement. The method in the disclosed embodiments substantially includes the steps necessary to carry out the functions presented above with respect to the operation of the described apparatus and system. The steps of guiding, recommending, and instructing maybe documented in written matter provided along with the game, or performed at least in part by a lifestyle improvement coach. In one embodiment, the method includes selecting from among the plurality of game elements at least in part in a predetermined sequence. The method also may include selecting from among the plurality of game elements at least in part in a random sequence.

In a further embodiment, the method includes timing device that times the actual accomplishment of the activity in pursuit of a lifestyle improvement goal by the player, according to a timing criterion that comprises at least one of a lower time limit and an upper time limit. For example, a lower time limit may be applied to the duration of a given physical exercise as part of the activity. Alternatively, an upper time limit may be applied to the amount of time required to complete the activity.

The method may also comprise restoring the spatial representation of the game to a state corresponding to all or part of the written representation in the journal. This may be a useful feature if the game needs to be temporarily put away or is accidentally disturbed.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which:

FIG. 4 illustrates a score card to allow players to keep track of their points for each game card completed and track the winner.

FIG. 7 illustrates another aspect of the game and includes two types of puzzle game boards FIG. 8 illustrates another aspect of the game in which the game cards are puzzle pieces.

DETAILED DESCRIPTION

Figure 1:
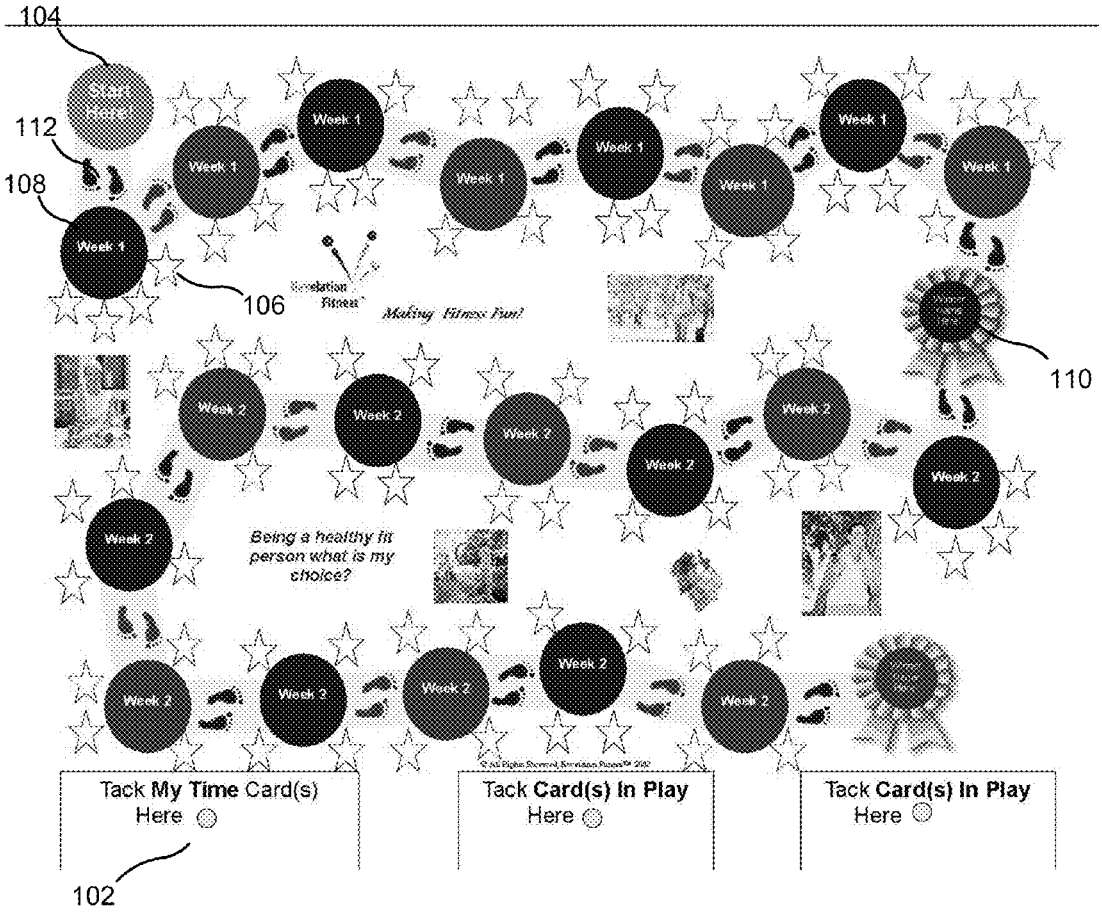
FIG. 1 illustrates a game board.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present invention relates to an exercise and weight loss game, build your business game, and balanced lifestyle game in which players complete activities stated on game cards and receive points as they move across the board, which can be a hard copy, digital, or virtually online on the computer. Activities include, but are not limited to: exercise, nutrition, journaling, supporting others, visualizations, tracking methods, calls, emailing their results, or submitting their results virtually and other lifestyle activities to succeed with changing their lifestyle behavior, reach their predetermined goals for the lifestyle game being played and winning the game.

In accordance with a first aspect of the present invention, a lifestyle game is provided. In one aspect, the game includes a game board, a journal for recording selected objectives or goals, and a plurality of game cards providing selected motivational activities that maybe completed in furtherance of such objectives or goals. Completion of the activities set forth on the game cards should result in a desired lifestyle outcome. The game may also be played by a single player, who may optionally compete against himself or herself, against a virtual opponent, or against a normative value. The game may be played by one, two or more players.

In a related aspect, the lifestyle game runs for a pre-determined duration of time, which may be as little as a few hours, a day, two or more days, one week, two weeks, several weeks, or even one or more months. In general, the duration of the game will be appropriate to achieving and sustaining the desired lifestyle change. In another aspect, pre-printed game cards are grouped and arranged in a logical order to achieve the desired lifestyle outcome.

In another related aspect, the game may include a countdown timing device, such as a digital clock or a stopwatch, of which may be built into a game-computer. The timing device may be used to time or limit the time of one or more selected activities.

In another related aspect, the game cards are not arranged in a logical order, but instead pulled randomly by the player or players and player or players must complete the activities on said game card within a predetermined time frame in order to acquire card and play it on the game board.

In another related aspect, the game cards or exemplary marking may also include means for marking progress on the game board such as creating something like a puzzle, or to move along the game board but is not limited to such actions. Exemplary marking means may include, but are not limited to, tokens, game pieces, erasable or permanent markers, electronic or digital marking devices or the like. The game may also provide additional challenge activities for providing extra points for a player.

In yet a further embodiment, the game may include reward symbols for recognizing a player who completed a challenge activity on a game card and/or achieved the most points during a pre-selected game interval. The reward symbol may be given to the player, and may be affixable, such as to the player's clothing or to the game board. By way of example but not limitation, the reward symbol may be a colored star sticker.

In a related embodiment, the invention includes a method for achieving a desired lifestyle. Generally, the method involves playing the game of the invention described herein to achieve one or more lifestyle goals or objectives, such as better physical fitness, better nutrition, losing weight, better financial management, increase in clientele or business revenue or any of a number of additional lifestyle goals, such as are described herein or will be appreciated by the skilled practitioner.

The game of the present invention includes, in one embodiment, various health and weight loss activities for successful health and fitness and weight loss—calories, nutrition, exercise, journaling, tracking, emailing or submitting results online and attitude. Other lifestyle games in accordance with the present invention include, but are not limited to, games directed at increasing clients, income, time off, relationship building and other lifestyle activities. By giving players exact descriptions of what to focus on next with a lifestyle activity and requiring them to interact and do the activities as the only means to move forward along the game board to play and win the game, players learn to make changes in their life for a better quality of life or to reach a desired outcome or goal, as the case may be. The present game maybe played individually or by a plurality of players, optimally, from two to four players; though it is understood that the game can be expanded to accommodate additional players, such as five players, six players, seven players, eight players, nine players, or even ten or more players, by simply expanding the format described herein, according to methods that will be apparent to the skilled practitioner.

All player(s) engage in an individual objective or goal of their choice determined by using the journal and journal game card when the activity is written on said game card and card is pulled either randomly or predetermined through the sequence of the game.

Player(s) use the present invention as an intended lifestyle program to reach a certain lifestyle goal and maintain said goal for the rest of their lives.

In an embodiment, player(s) record in their respective journals one big game goal they intend to reach by the end of the entire game. Weekly, players record smaller goals they intend to reach by the end of each week taking them closer to the one big goal to be achieved by the end of the game. Player(s) use the game card activities to achieve said goals.

An additional embodiment, one game card activity ask player to send an email of their weight lost and inches lost or submit their inches and weight lost online to be tracked. A virtual online game system or management tracks the total number of weight lost by all players cumulatively and individually.

Figure 6:
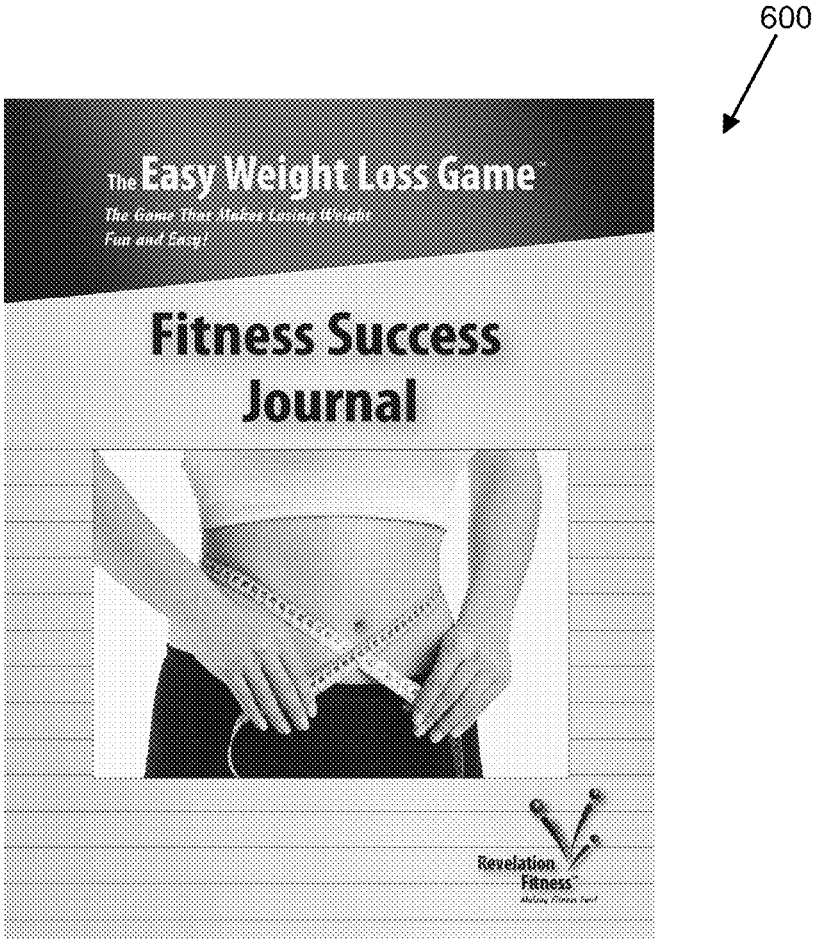
FIG. 6 illustrates a journal for use in the game

At the beginning of the game player(s) take their measurements or inventory in the journal 600 of FIG. 6 of what they currently have in their life and record the results into the provided journal. At the beginning of each week the journal game card requires players to record the results in reaching their game goal into their journal. At the end of the game player has a complete journal of their progress throughout the game. Although the foregoing describes a journal appropriate for a fitness or weight loss game, all lifestyle games will have a similar journal. Meditation and visualization exercises may also accompany journals to support players in shifting their current reality of a particular lifestyle to a fun and more inspiring reality that serves them and reaching their goal for the lifestyle game they are playing.

Figure 5:
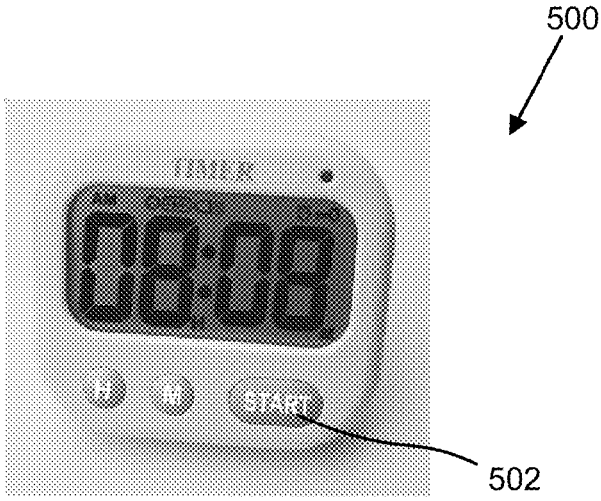
FIG. 5 illustrates a count down devices that may be used in conjunction with the embodiment of the present invention.

In an embodiment, the present game may include as many individual playing board games, as illustrated in FIG. 1, and FIG. 7 that provides for the varying weeks to be played, one count down device in this case a timer 500, as illustrated in FIG. 5, 86 or more or less game cards (FIG. 2) with seven or more or less game categories (202 of FIG. 2) varying activities including but not limited to: physical activity, nutrition, journaling, heart rate training, submitting their results, support others, business calls, relationship activities, money activities, and various tracking methods.

In another aspect of the game may include individual game cards FIG. 8, where the back 802 of said game card is a puzzle piece and the front 804 is an activity player(s) must achieve within a predetermined time frame or they must pull another game card. After completing said activity the completed game card goes on the corresponding horizontal game board 702 or vertical game board 704 in FIG. 7 and a picture is created.

Activities on the game cards may include, but are not limited to, physical exercise, a nutrition choice, journal writing, heart rate challenge, tracking, income, submitting results, visualization, meditation, supporting another player, friend, or colleague, calls, tracking income, or any activity associated with the lifestyle game being played.

Games of the invention may also include game scorecards, a cork board or other means for displaying the game board, game tokens, or pieces, game cards, or other means to mark progress on the game board, challenge reward symbols, such as star stickers or other reward symbols, score recording materials, such as a pencil or a pen and a scorecard or a digital or virtual scorekeeping device, a plurality of journals (one for each player), a game instruction CD, and the like. As noted above, the game of the invention can accommodate a number of different lifestyle goals, alone or in combination. By way of illustration, but not limitation, lifestyle games directed at physical activity or fitness goals may also include specific workout tools, such as a workout DVD, a cardio DVD or CD, a measuring tape, a Physical Active Readiness Questionnaire, an exercise band, or other fitness aids known in the art.

Games directed at improving nutrition or diet may include menus, food caloric content lists, recipes, food journals, and the like. As preparation to play the game, the individual game board may be tacked to a cork board or other adhesive surface suitable for displaying the game board or the game board itself may be magnetic, use Velcro or stand alone. The game board can also be virtual and played online. When the time frame for the current game board has expired, the game board can be removed and a new game board representing the next week's game to be played put in its place. If online, the game boards will change automatically to represent players' position on the board and represent the week being played.

Figure 2:
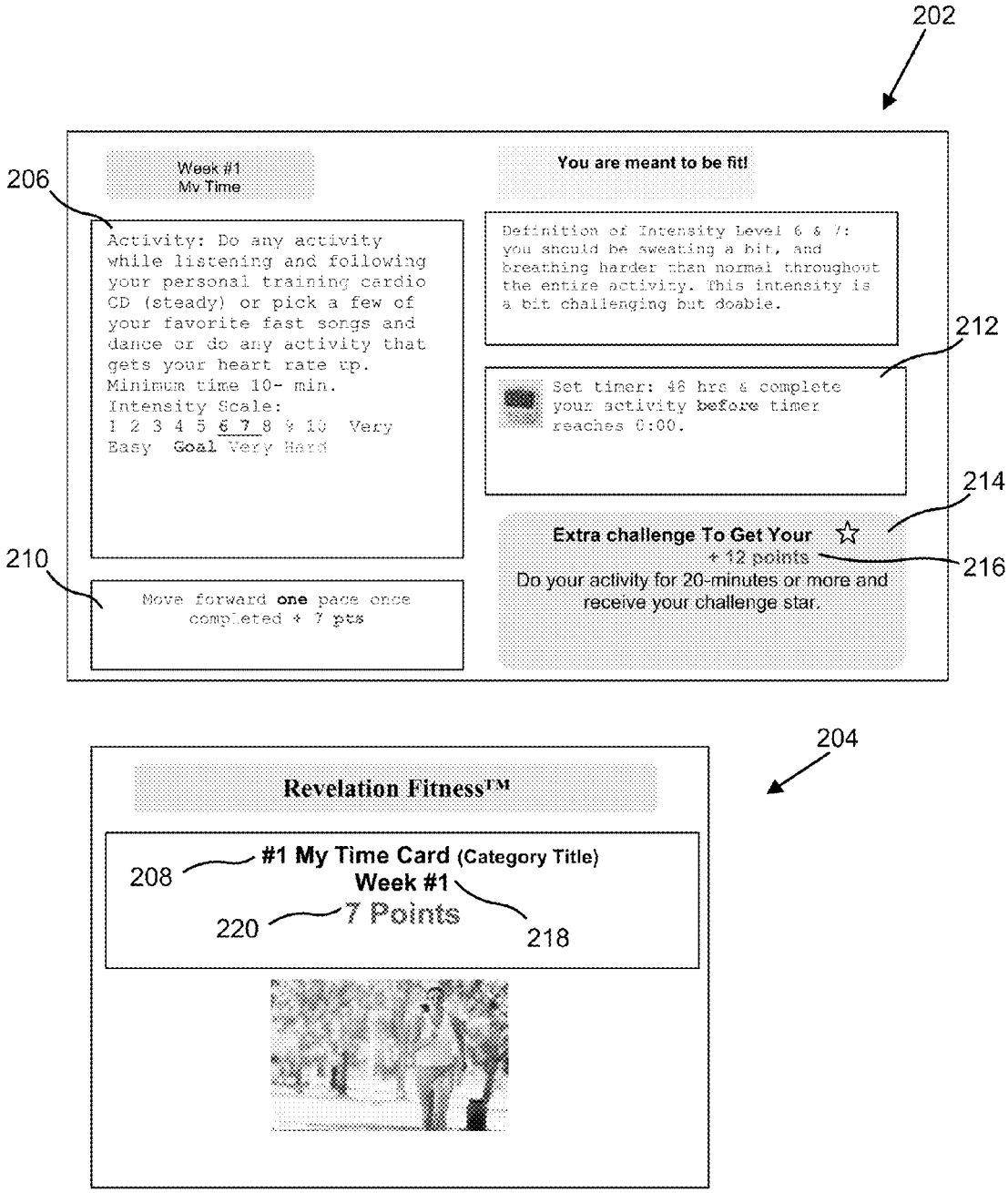
FIG. 2 illustrates a game card for use in moving the player forward on the game board.

The first sequence of game cards having a face 202 and a back 204 in FIG. 2 for the first week 1 of FIG. 2 to be played should be tacked to the bottom of the game board in their predetermined location 102 on the board of FIG. 1. Each player should be given a journal. The players may then select their game pieces and place the game pieces on the starting space 104 of FIG. 1 on the game board. Players also choose their reward symbol or color they will be for the game, illustrated herein by colored stars 106. Players start in the start here circle 104 of FIG. 1 and move along game board of FIG. 1 by moving their game pieces onto the space holders 108 represented herein by circles, but not limited to circles, which indicate the week being played.

When the week has ended the player who has the most points wins the week. The winner writes his or her name on the score card 404 of FIG. 4 and a winner's token, illustrated by ribbon 110 of FIG. 1 is placed on the game board. Players flip the score card booklet to show the next week to be played and repeat the methods above until all weeks are completed.

The game ends when the pre-determined game time frame, which in the current illustration is 6-weeks, has ended. The player, who has received the most points, wins the game.

In another aspect of the game the player(s) does not receive points. Instead their progress is measured by the amount of puzzle pieces on the game board, which are actual completed game cards. Further progress is shown by the quantity of "yes's" player(s) has received from journaling their good and bad nutrition choices.

In this aspect of the game player wins by completing the puzzle within the predetermined time frame of the game and receiving the required predetermined number of "yes" responses in their journal.

A further aspect of the present invention relates to the structure of the game which may be played in accordance with the above-described methods. In one embodiment, the game of the present invention comprises a physical game board FIG. 1, digital board, or virtual online method having one game path 112 of FIG. 1. The game board also includes space holders 108 of FIG. 1, which indicate week being played. Space holders currently circles but not limited to circles, for players to move forward onto after completing a game card. The game board also includes challenge reward space holders 106 of FIG. 1, currently stars but not limited to stars.

A plurality of colored game pieces are provided where a single game piece is preferably selected by each player. A plurality of game card categories with the following but not limited to the following activities: physical, mental, and emotional activities, for player(s) to complete in order to move forward on the game board are provided.

In accordance with an embodiment of the present game, the plurality of game cards and their associated activities progresses in intensity as the player moves forward on the game board.

In various embodiments, the game can be supplied with one or more categories of game cards pertaining to particular lifestyle activities for the game being played.

In an illustrative game sequence, a player places the first sequence of game cards for the first week on a predetermined spot on the game board, choosing the first game card and doing the activity described on that game card, usually on the face of the card.

In another aspect of the game the player(s) pulls a random game card from the game card box and does the activity within the predetermined time stated on said game card.

In an embodiment, but not required the game will employ a count-down device to count down from a predetermined amount of time, which may be specified on the game card, or may be uniformly specified, according to the particular playing mode preference, or as agreed among the players. The player will move his or her game piece forward on the game board after completing the activity described on the game card, and gains points, which may be specified by the game card or may be uniformly distributed among the game cards. Such points may be conveniently recorded on a game score card or in the player's journal, or other location that is available to all concurrent players. Players then continue to the next game card and repeat the process until all activities on the game cards for the week being played are completed, at which time players can elect to do more activities relating to the game cards and receive more points.

In another aspect of the game when player(s) completes a randomly chosen game card within the allotted time frame of said game card they place the card on the game board directly on the number corresponding to the game card and a picture starts to emerge.

Players can win part of the game on a weekly basis. At the end of the pre-determined interval, in the current invention 7-days, to determine which player won the week's game players count up the points each has received. The player with the most points wins the week. Players then continue to the next week's sequence of game cards and repeat the above until all game cards are completed within the predetermined time set by the game and player has moved to the end of the game board.

To win the game a player must receive the most points. Extra points can be received by doing challenge activities on game cards and doing extra activities after game cards are completed.

In another aspect of the game no points are received. Instead player(s) visually see their progress. Player(s) win(s) by completing the puzzle picture within the predetermined time frame of the game and if stated in the game, receiving a predetermined number of "yes's" from their journal. One or more player(s) may win at the same time.

In an exemplary game sequence, a player uses a game piece and selects the first sequence 208 of FIG. 2 of a game card FIG. 2 from the first week 1 of FIG. 2. The player does the activity 206 of FIG. 2 on the face of the first game card. The player then moves forward on the game board 108 of FIG. 1 and adds all points from the game card 210 of FIG. 2 and any other game card activities completed for that day cumulatively onto the score card 402 of FIG. 4. The player follows with the second game card in sequence 208 of FIG. 2 and repeats the above, adding points cumulatively to the score card on the appropriate day after all activities for that day are completed.

Game card activities may be accomplished out of sequence and at anytime during the game provided the time for the game, which in the current invention is 4 and 6-weeks, hasn't expired. The sequence of the game cards is designed to keep player focused on various aspects of the lifestyle goal they want to achieve by playing the game.

Particular game cards may also comprise the step of using a count down device 500 (FIG. 5) to set as an added stimulant 212 of FIG. 2 for the player to complete activity on the game card within a set time period. Here, the player sets the count down device (shown here as a timer) to the amount of time recommended on the game card. The count down device begins when player presses start 502 of FIG. 5. The player has that amount of time to complete the activity on the game card before the time expires. Once completed, the player moves forward on the game board 108 of FIG. 1. If the player doesn't complete the activity within the time allotted, he or she forfeits that game card and the points associated with the game card, but the player can optionally go back to complete the game card at a later time assuming the game duration hasn't expired. It should be appreciated that count down devices, other than timers, may be used to play the present game. For example, an hour glass, a stop-watch, or any device representing time may be used.

In another aspect of the game there is no sequence of game cards, starting position, no points to receive by completing said game card or path in which markers are placed. Game cards FIG. 8 are draw at random by a player and if completed within the predetermined time frame the game card placed on the game board FIG. 7. If the game card is not completed within the predetermined time frame, it is placed back in the box and another card is pulled.

Each game card may include an optional extra activity challenge 214 of FIG. 2 that corresponds to the main activity on the game card. For example, if a game card's main activity is a 10 minute walk, the extra challenge might be a 20 minute walk. Each player has a choice to complete the extra challenge activity or not. If the player completes the extra activity, he or she receives the extra points for the challenge 216 of FIG. 2 and may also place his or her reward symbol 106 of FIG. 1, in this case a star sticker onto a reward symbol associated with the space holder 108 of FIG. 1 player has moved to on the game board. Reward symbols may be different colors or shapes, and players may choose their reward symbol before the game begins.

Figure 3:
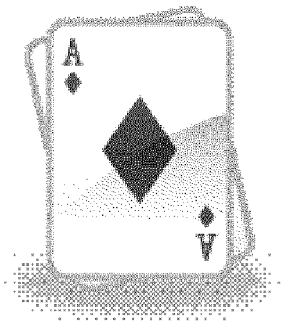
FIG. 3 illustrates a wild game card to be used as a freebie for player to use at any time.

As an additional option, a player may at times pull a wild game card having a face 302 and a back 304 in FIG. 3 and that game card will give the player a free completion to use on any forfeited game card allowing player to move forward on the board as if they completed the game card and receive both points for game card activity and the game card extra challenge. The wild game card will also allow the player to place his or her reward symbol on the game board as if they completed the optional extra challenge associated with the forfeited game card.

A starting space 104 is provided on the game board of FIG. 1. Player pulls out game cards in sequence for the given week 218 of FIG. 2 and places them on the predetermined location 102 on the game board of FIG. 1.

The steps of moving the game piece along the game board is determined by player's completion of the activities on the game cards associated with that given week. Players move game pieces one pace forward onto the space holder 108 of FIG. 1 in this case circles (but not limited to circles) each time they complete a game card activity. A player can win every week (or other pre-determined interval) by receiving the most points 406 of FIG. 4 on the completed game cards associated with the interval (such as week 218 of FIG. 2), moving game piece forward on the game board with each activity completed 108 of FIG. 1 and within the time frame of said week. A player will win the game by receiving the most points.

Extra points are given when players choose to do extra activities after completing any game card category before the week being played has ended. When any category game card is completed and the player chooses to do another activity in that category, he or she will receive an extra predetermined amount of points for that week 408 of FIG. 4. Players add extra points cumulatively onto their score cards for the day 402 of FIG. 4.

At the end of each week or other pre-determined interval, players add up all their points for the week to determine that week's winner. The winning player for each week writes his or her name, number of points achieved for the week and date on the score card 410 of FIG. 4 and writes his or her name and number of points on the winning symbol, in this case a ribbon, and places the symbol in the appropriate location 110 on the game board of FIG. 1. The player who wins the game will have completed all game cards and received the most points for the entire game. The winner writes their name, points achieved and date onto the front of the score booklet that was used for the game 404 of FIG. 4.

Game cards may consist of a predetermined number of cardio and strength training workouts requesting a predetermined time allotted for each workout. As player(s) progress through the game, the activities, and intensities of activities associated with the lifestyle game they are playing may increase in intensity.

In accordance with an embodiment of the present game a journal, illustrated in FIG. 6, is associated with the journal game card or the journaling activity is an addition to another activity already on a game card. The journal instructions on said game care are used by players to track their progress in reaching their goal for the lifestyle game they are playing. FIG. 6 illustrates this but is not meant to limit the invention to this particular lifestyle game.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a plurality of game elements, wherein information regarding an activity in pursuit of a lifestyle improvement goal is displayed on a surface of each game element;

a game framework comprising a spatial representation of an actual accomplishment by a player of the activity in pursuit of the lifestyle improvement goal; and a journal comprising a written representation of the actual accomplishment by the player of the activity in pursuit of the lifestyle improvement goal.

2. The apparatus of claim 1, wherein the game element comprises a puzzle piece, and the spatial representation comprises an assemblage of the puzzle pieces within the game framework.

3. The apparatus of claim 1, wherein the spatial representation includes a reward symbol.

4. The apparatus of claim 1, wherein the activity includes an extra challenge by which the player can make further progress in the game.

5. The apparatus of claim 1, wherein the plurality of game elements includes one or more wildcard elements by which the player can make further progress in the game without actual accomplishment of the activity displayed on the surface of another game element.

6. The apparatus of claim 2, wherein the assemblage comprises an image, the puzzle piece comprises a card with a portion of the image on a back thereof, the surface comprises a face of the card, and the game framework comprises a game board to receive the card face-down.

7. The apparatus of claim 2, wherein the puzzle piece and the assemblage are three-dimensional.

8. The apparatus of claim 3, wherein the reward symbol indicates successful completion of the activity.

9. The apparatus of claim 3, wherein the reward symbol indicates successful progress in playing the game through a predetermined time period.

10. A system comprising:

a plurality of game elements, wherein information regarding an activity in pursuit of a lifestyle improvement goal is displayed on a surface of each game element;

a game framework comprising a spatial representation of an actual accomplishment by a player of the activity in pursuit of the lifestyle improvement goal;

a journal comprising a written representation of the actual accomplishment by the player of the activity in pursuit of the lifestyle improvement goal; and a timing device that times the actual accomplishment of the activity in pursuit of a lifestyle improvement goal by the player.

11. The system of claim 10, further comprising a computing environment in which the game is implemented as a software application.

12. The system of claim 11, wherein the software application is at least partially web-based.

13. The system of claim 12, wherein the web-based software application enables geographically dispersed players to play the game together.

14. A method comprising the steps of:

providing a game comprising a plurality of game elements, wherein information regarding an activity in pursuit of a lifestyle improvement goal is displayed on a surface of each game element, a game framework comprising a spatial representation of an actual accomplishment by a player of the activity in pursuit of the lifestyle improvement goal, and a journal comprising a written representation of the actual accomplishment by the player of the activity in pursuit of the lifestyle improvement goal;

guiding an individual to set the lifestyle improvement goal, appropriate to the individual's needs and circumstances;

recommending that the individual play the game and actually perform the activity displayed on the face of each game element selected while playing the game; and instructing the individual in a playing procedure of the game.

15. The method of claim 14, wherein the playing procedure comprises selecting from among the plurality of game elements at least in part in a predetermined sequence.

16. The method of claim 14, wherein the playing procedure comprises selecting from among the plurality of game elements at least in part in a random sequence.

17. The method of claim 14, wherein the game further comprises a timing device that times the actual accomplishment of the activity in pursuit of a lifestyle improvement goal by the player, according to a timing criterion that comprises at least one of a lower time limit and an upper time limit.

18. The method of claim 14, further comprising a step of restoring the spatial representation of the game to a state corresponding to all or part of the written representation in the journal.

19. The method of claim 14, wherein the steps of guiding, recommending, and instructing are performed at least in part through written matter provided along with the game.

20. The method of claim 14, wherein the steps of guiding, recommending, and instructing are performed at least in part by a lifestyle improvement coach.

* * * * *

UNITED STATES PATENT AND TRADEMARK OFFICE

CERTIFICATE OF CORRECTION

PATENT NO. : 8,100,757 B2
APPLICATION NO. : 12/479680
DATED : January 24, 2012
INVENTOR(S) : Michelle Melendez It is certified that error appears in the above-identified patent and that said Letters Patent is hereby corrected as shown below:

Column 2, Line 43
"includes timing"---should read "includes a timing"

Column 4, Line 32
"that maybe completed"---should read "that may be completed"

Column 5, Line 51-52
"ask player"---should read "asks players"

Column 5, Line 63
"player has"---should read "players have"

Column 6, Line 2
"them and reaching"---should read "them in reaching"

Column 6, Line 11-12
"support others"---should read "supporting others"

Column 8, Line 66
"are draw at random"---should read "are drawn at random"

Column 9, Line 35
"one pace forward"---should read "one space forward"

Column 10, Line 8
"game care"---should read "game card"

Signed and Sealed this
Eighth Day of January, 2013

David J. Kappos

David J. Kappos
*Director of the United States Patent and Trademark Office*